US006183928B1

(12) United States Patent
Sata et al.

(10) Patent No.: US 6,183,928 B1
(45) Date of Patent: Feb. 6, 2001

(54) TONER FOR FULL COLOR DEVELOPMENT

(75) Inventors: Shinichi Sata; Eiji Shirai, both of Wakayama (JP)

(73) Assignee: Kao Corporation, Tokyo (JP)

( * ) Notice: Under 35 U.S.C. 154(b), the term of this patent shall be extended for 0 days.

(21) Appl. No.: 09/537,770

(22) Filed: Mar. 30, 2000

(30) Foreign Application Priority Data

Apr. 1, 1999 (JP) ..... 11-095148

(51) Int. Cl.[7] ..... G03G 9/087; G03G 9/097
(52) U.S. Cl. ..... 430/110; 430/111
(58) Field of Search ..... 430/110, 111

(56) References Cited

U.S. PATENT DOCUMENTS

| | | | | |
|---|---|---|---|---|
| 5,047,305 | * | 9/1991 | Uchida et al. | 430/111 |
| 5,660,964 | * | 8/1997 | Machida et al. | 430/111 |
| 5,804,347 | * | 9/1998 | Inoue et al. | 430/111 |
| 5,843,605 | * | 12/1998 | Anno et al. | 430/110 |
| 6,077,639 | * | 6/2000 | Semura et al. | 430/111 |
| 6,106,986 | * | 8/2000 | Shirai et al. | 430/110 |

OTHER PUBLICATIONS

Patent Abstracts of Japan, Publication No. JP–A–6–59505.
Patent Abstracts of Japan, Publication No. JP–A–8–220808.
Patent Abstracts of Japan, Publication No. JP–A–11–44969.
Patent Abstracts of Japan, Publication No. JP–10–268572.
Patent Abstracts of Japan, Publication No. JP–A–10–73952.

* cited by examiner

*Primary Examiner*—Roland Martin
(74) *Attorney, Agent, or Firm*—Birch, Stewart, Kolasch & Birch, LLP

(57) ABSTRACT

A toner for full color development comprising (a) a resin binder comprising a polyester; (b) a releasing agent having a melting point of 60° to 115° C.; (c) a colorant; and (d) an external additive, wherein the toner has a sum of an acid value and a hydroxyl value of from 40 to 60 KOH mg/g, a softening point of from 97° to 115° C., and a glass transition point of from 58° to 65° C., and wherein the amount of the external additive is from 1 to 5 parts by weight, based on 100 parts by weight of a toner without a treatment with the external additive. There can be provided a toner for full color development having a wide fixable region, and being excellent in the durability and the color reproducibility.

10 Claims, No Drawings

TONER FOR FULL COLOR DEVELOPMENT

BACKGROUND OF THE INVENTION

1. Field of the Invention

The present invention relates to a toner for full color development used for development of electrostatic latent images which are formed in electrophotography, electrostatic recording method, electrostatic printing method, or the like.

2. Discussion of the Related Art

Heat roll fixing methods have been widely employed as a method for fixing of a visible image. In the toner for full color development, since a polymer having a low molecular weight and a narrow molecular weight distribution is used as a resin binder in order to satisfy the melting characteristics important for color reproducibility, the resulting toner has a narrow fixable region. In order to solve such a problem, therefore, a silicone oil is applied on a heat roll. However, there arise such defects that the device becomes larger in size, and that a silicone oil remains on the transferred sheets, which makes it difficult to over-write thereon.

Japanese Patent Laid-Open Nos. Hei 6-59505, Hei 8-220808, and the like each discloses a toner comprising a polyester and a releasing agent having a low melting point. However, there have not yet been reported any toners satisfying many of properties required for toners for full color development such as durability and color reproducibility.

An object of the present invention is to provide a toner for full color development having a wide fixable region, and being excellent in durability and color reproducibility.

The above object and other objects of the present invention will be apparent from the following description.

SUMMARY OF THE INVENTION

The present invention relates to a toner for full color development comprising:

(a) a resin binder comprising a polyester;

(b) a releasing agent having a melting point of 60°to 115° C.;

(c) a colorant; and (d) an external additive, wherein the toner has a sum of an acid value and a hydroxyl value of from 40 to 60 KOH mg/g, a softening point of from 97° to 115° C., and a glass transition point of from 58° to 65° C., and wherein the amount of the external additive is from 1 to 5 parts by weight, based on 100 parts by weight of a toner without a treatment with the external additive.

DETAILED DESCRIPTION OF THE INVENTION

The toner of the present invention has a sum of an acid value and a hydroxyl value of 40 KOH mg/g or more, in order to improve the durability, and a sum of 60 KOH mg/g or less, in order to improve the color reproducibility. Therefore, the toner has a sum of an acid value and a hydroxyl value is from 40 to 60 KOH mg/g, preferably from 42 to 50 KOH mg/g. The sum of an acid value and a hydroxyl value corresponds to the number of terminal functional groups per unit weight, and the sum is closely related to many of molecular structural features such as polarity, average molecular weight, and cross-linking degree of a resin binder which is a main component of the toner. Therefore, the sum is an index highly significant to the toner properties such as durability, triboelectric chargeability, and color reproducibility.

The toner of the present invention has an acid value of preferably from 1 to 50 KOH mg/g, more preferably from 1 to 30 KOH mg/g, in order to obtain an appropriate level of the triboelectric charges.

The toner of the present invention has a hydroxyl value of preferably from 10 to 60 KOH mg/g, more preferably from 10 to 50 KOH mg/g, still more preferably from 20 to 50 KOH mg/g, from the viewpoint of the environmental stability of the triboelectric charges.

The toner of the present invention has a softening point of from 97° to 115° C., preferably from 98° to 112° C., from the viewpoint of the fixable region.

The toner of the present invention has a glass transition point of from 58° to 65° C., preferably from 60° to 63° C., from the viewpoints of the storage stability and the durability.

The resin binder usable for the toner of the present invention comprises one or more kinds, preferably from 1 to 3 kinds of polyesters. It is desired that the content of the polyester is from 50 to 100% by weight, preferably from 90 to 100% by weight, more preferably 100% by weight, in the resin binder, from the viewpoints of the dispersibility of the colorant, the fixing ability and the durability. Incidentally, the resins which can be used for the resin binder other than the polyester include styrene-acrylic resins, epoxy resins, polycarbonates, polyurethanes, and the like.

The polyester is obtainable, for instance, by polycondensing an alcohol component comprising a compound represented by the formula (I):

(I)

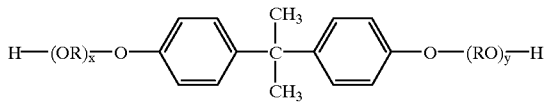

wherein R is an alkylene group having 2 to 4 carbon atoms; and each of x and y is a positive number, wherein a sum of x and y is from 1 to 16, with a carboxylic acid component comprising a dicarboxylic acid compound.

In the present invention, the alcohol component contains the compound represented by the formula (I) in an amount of preferably 5% by mol or more, more preferably 50% by mol or more from the viewpoints of the dispersibility of the colorant and the fixing ability.

The compound represented by the formula (I) includes alkylene oxide adducts (additional molar number: 1 to 16) of bisphenol A such as polyoxypropylene(2.2)-2,2-bis(4-hydroxyphenyl)propane and polyoxyethylene(2.2)-2,2-bis(4-hydroxyphenyl)propane. In addition, other alcohol components include ethylene glycol, propylene glycol, glycerol, pentaerythritol, trimethylolpropane, hydrogenated bisphenol A, sorbitol, or alkylene oxide adducts (additional molar number: 1 to 16) thereof of which alkylene moiety has 2 to 4 carbon atoms. These alcohol components comprise one or more of these compounds.

The carboxylic acid component comprises a dicarboxylic acid compound and, optionally, a tricarboxylic or higher polycarboxylic acid compound.

The dicarboxylic acid compound includes phthalic acid, isophthalic acid, terephthalic acid, fumaric acid, maleic acid, adipic acid, substituted succinic acids having a substituent such as an alkyl group having 1 to 20 carbon atoms or an alkenyl group having 2 to 20 carbon atoms such as dodecenylsuccinic acid and octylsuccinic acid, anhydrides thereof, and alkyl(1 to 8 carbon atoms) esters thereof, and the like.

The tricarboxylic or higher polycarboxylic acid compound includes trimellitic acid, pyromellitic acid, acid anhydrides thereof, alkyl(1 to 8 carbon atoms) esters thereof, and the like.

The polycondensation of the alcohol component with the carboxylic acid component can be carried out, for instance, by reacting the components at a temperature of from 180° to 250° C. in an inert gas atmosphere, optionally in the presence of an esterification catalyst.

The toner of the present invention comprises one or more kinds, preferably 1 to 3 kinds, of polyesters. Here, in one embodiment, a linear polyester is preferably used. In addition, the linear polyester is excellent in the fixing ability and the color reproducibility, while a cross-linked polyester is excellent in the durability. Therefore, in another embodiment, these two kinds of polyesters are used in admixture.

In the present invention, the linear polyester is preferably one obtained by using a carboxylic acid component comprising a tricarboxylic or higher polycarboxylic acid compound in an amount of less than 5% by mol and/or an alcohol component comprising a trihydric or higher polyhydric alcohol in an amount of less than 5% by mol, especially one obtained by using an alcohol component and a carboxylic acid component without containing any of trihydric or higher alcohol and tricarboxylic or higher polycarboxylic acid compound.

Also, the cross-linked polyester is preferably one obtained by using a carboxylic acid component comprising a tricarboxylic or higher polycarboxylic acid compound in an amount of from 5 to 50% by mol and/or an alcohol component comprising a trihydric or higher polyhydric alcohol in an amount of 5 to 50% by mol, especially one obtained by using the carboxylic acid component comprising a tricarboxylic or higher polycarboxylic acid compound in an amount of 5 to 50% by mol. Incidentally, in this case, it is more preferable that the carboxylic acid component comprises the dicarboxylic acid component in an amount of 50 to 95% by mol in addition to the tricarboxlylic or higher polycarboxylic compound.

In the present invention, as described above, the linear polyester may be used alone, or the linear polyester and the cross-linked polyester may be used in admixture, wherein a weight ratio of the cross-linked polyester to the linear polyester is preferably from 70/30 to 0/100, more preferably from 50/50 to 0/100.

Incidentally, it is preferable that each of the polyesters satisfies the following properties.

The polyester has a sum of an acid value and a hydroxyl value of preferably from 20 to 100 KOH mg/g, more preferably from 35 to 80 KOH mg/g, from the viewpoints of the durability and the color reproducibility.

The polyester has an acid value of preferably 50 KOH mg/g or less, more preferably 1 to 30 KOH mg/g, in order to obtain an appropriate level of the triboelectric charges.

The polyester has a hydroxyl value of preferably from 10 to 60 KOH mg/g, more preferably 20 to 50 KOH mg/g, from the viewpoint of the environmental stability of the triboelectric charges.

The polyester has a softening point of preferably from 95° to 125° C., more preferably from 97° to 115° C., from the viewpoints of the fixable region and the durability.

The polyester has a glass transition point of preferably from 50° to 70° C., more preferably from 55° to 65° C., from the viewpoints of the storage stability and the durability.

The polyester has a weight-average molecular weight of preferably from $1.0\times10^3$ to $1.0\times10^6$, more preferably from $5.0\times10^3$ to $5.0\times10^5$, from the viewpoints of the fixable region, the durability and the color reproducibility. Incidentally, when two or more kinds of the polyesters are used in admixture as a binder resin, it is preferable that the resulting resin has also a weight-average molecular weight within the range described above.

The releasing agent usable in the toner of the present invention includes natural waxes such as carnauba wax and rice wax; synthetic waxes such as polypropylene wax, polyethylene wax, and Sazole wax; coal waxes such as montan wax, and the like. Among these waxes, carnauba wax is preferable, from the viewpoint of its compatibility with the polyester resin.

From the viewpoints of the fixable region and the color reproducibility, the releasing agent has a melting point of from 60° to 115° C., preferably from 75° to 110° C., and the content of the releasing agent is preferably from 1 to 10 parts by weight, more preferably from 1.5 to 5 parts by weight, based on 100 parts by weight of the resin binder.

The colorant usable for the toner of the present invention may be any of dyes and pigments conventionally used for the colorant for full color development without particular limitation. From the aspect of the color reproducibility, it is preferable to respectively use a yellow pigment including one or more yellow pigments selected from the group consisting of C.I. Pigment Yellow (hereinafter referred to as "P.Y.") 17, P.Y. 93, P.Y. 128, P.Y. 151, P.Y. 155, P.Y. 173, P.Y. 180, P.Y. 185, and Solvent Yellow (hereinafter referred to as "S.Y.") 162; a magenta pigment including one or more magenta pigments selected from the group consisting of C.I. Pigment Red (hereinafter referred to as "P.R.") 57:1, P.R. 122, and P.R. 184; and a cyan pigment including one or more cyan pigments selected from the group consisting of C.I. Pigment Blue (hereinafter referred to as "P.B.") 15:3, P.B. 15, P.B. 15:4, and C.I. Pigment Green (hereinafter referred to as "P.G.") 7. The amount of the colorant used is preferably from 0.5 to 10 parts by weight, based on 100 parts by weight of the resin binder. The toner of the present invention can be used as toner for full color development by blending with these colorants.

In the present invention, in order to impart flowability to the toner and to even more effectively prevent filming onto the photoconductor, a relatively large amount of an external additive is used. The use of a large amount of external additive is made possible because various properties of the toner are specified as described above.

The external additive usable for toner of the present invention includes silicon dioxide (silica), titanium dioxide (titania), aluminum oxide, zinc oxide, magnesium oxide, cerium oxide, iron oxides, copper oxides, tin oxide, and the like, among which a preference is given to silica from the aspect of imparting the triboelectric chargeability. Particularly in the present invention, a preference is given to hydrophobic silica which has been subjected to hydrophobic treatment with hexamethyldisilazane, a silicone oil, or the like.

Commercially available hydrophobic silica subjected to hydrophobic treatment includes "AEROSIL R-972" (manufactured by Nihon Aerosil K.K., average particle size: about 16 nm); "HDK H2000" (manufactured by Wacker Chemicals, average particle size: about 12 nm); "CAB-O-SIL TS-530" (manufactured by CABOT, average particle size: about 8 nm), and the like. These external additives may be used alone or in admixture of two or more kinds.

The particle size of the external additive is preferably from 4 to 200 nm, more preferably from 8 to 30 nm. The particle size of the external additive can be determined by using a scanning electron microscope or transmission electron microscope.

The content of the external additive is from 1 to 5 parts by weight, preferably from 1.5 to 3.5 parts by weight, based on 100 parts by weight of the toner without a treatment with the external additive. In a case where a hydrophobic silica is used as an external additive, however, the desired effect as described above is obtained by adding the hydrophobic silica in an amount of 1 to 3 parts by weight, based on 100 parts by weight of the toner without the treatment with an external additive.

The toner of the present invention is not particularly limited, and includes pulverized toners, polymerization toners, encapsulated toners, and the like. The toner of the present invention can be prepared, for example, by adding an external additive to a powder obtained by a conventionally known method, such as kneading-pulverization method, spray-drying method or polymerization method. In the present invention, the pulverized toner is preferably employed. For instance, a powder is prepared by homogeneously mixing a resin binder, a colorant, a releasing agent, and the like with a mixer such as a ball-mill, thereafter melt-kneading the mixture with a closed kneader, a single- or double-screw extruder, or the like, and subsequently cooling, pulverizing and classifying the product. Subsequently, the resulting powder and the external agent are stirred and mixed with a high-speed agitator such as Supermixer or a Henschel mixer, thereby depositing the external additive on the toner surfaces, to give the toner for full color development of the present invention. It is preferable that the toner of the present invention has a weight-average particle size of from 3 to 10 $\mu$m.

Incidentally, in the toner of the present invention, there can be added in appropriate amounts auxiliary agents such as charge control agents, conductive adjustment agents, extenders, reinforcing fillers such as fibrous materials, antioxidants, anti-aging agents, and the like.

The toner for full color development of the present invention may be used as a nonmagnetic one-component developer, or as a two-component developer in admixture with a carrier. Incidentally, when a full-color fixed image is formed by combining the toners for full color development of the present invention, it is preferable to combine the toners comprising the same resin binder.

In addition, the toner for full color development of the present invention has a very wide fixable region, so that it can be used even in a fixing device without an oil supplying equipment.

EXAMPLES

[Acid Value and Hydroxyl Value of Resin and Toner]

Determined in accordance with JIS K0070.

[Softening Point of Resin and Toner]

The softening point is a temperature at which one-half of resin or toner flows out when determined by using a Koka-type flow tester (Model "CFT-500" manufactured by Shimadzu Corporation) [sample: 1 g; heating rate: 6° C./min; applied load: 1.96 MPa; nozzle: 1 mm diameter and a length of 1 mm].

[Glass Transition Point of Resin and Toner and Melting Point of Releasing Agent]

Determined at a heating rate of 10° C./min by using a differential scanning calorimeter "DSC Model 210" (manufactured by Seiko Instruments, Inc.).

[Weight-Average Molecular Weight of Resin]

Determined by a GPC method (column: GMHLX+G3000HXL (manufactured by Tosoh Corporation); standard sample: monodisperse polystyrene).

Resin Preparation Example

The starting materials listed in Table 1 were reacted at 230° C. with stirring under nitrogen atmosphere until softening points as determined by a method in accordance with ASTM E28-67 reached the respective given temperatures, to give Resins A to I. The acid value (AV), the hydroxyl value (OHV), the sum of the acid value and the hydroxyl value (AV+OHV), the softening point (Tm), the glass transition point (Tg) and weight-average molecular weight (Mw) of each of Resins are shown in Table 1.

TABLE 1

| | Linear Polyester | | | | | | | Cross-linked Polyester | |
|---|---|---|---|---|---|---|---|---|---|
| | Low AV | | | High AV | | | | | |
| | High← Tm →Low | | | High← Tm →Low | | | High Tg | High Tm | Low Tm |
| | Resin A | Resin B | Resin C | Resin D | Resin E | Resin F | Resin G | Resin H | Resin I |
| PO-BPA[1)] | 12250 | 8750 | 8750 | 33250 | 33635 | 35000 | 35000 | 17500 | 24500 |
| EO-BPA[2)] | 21125 | 24375 | 24375 | 325 | — | — | — | 16250 | 9750 |
| Terephthalic acid | 14940 | 14774 | 14110 | 6640 | — | 6640 | 14110 | 11620 | 8300 |
| Fumaric acid | — | — | — | 6960 | 11600 | — | — | — | — |
| Adipic acid | — | — | — | — | — | 5110 | — | — | — |
| Alkenylsuccinic acid | — | — | — | — | — | — | — | 1340 | 6700 |
| Trimellitic acid | — | — | — | — | — | — | — | 4800 | 4800 |
| Dibutyltin oxide | 15 | 15 | 15 | 15 | 15 | 15 | 15 | 15 | 15 |
| AV (KOH mg/g) | 2 | 2 | 4 | 22 | 19 | 22 | 19 | 22 | 23 |
| OHV (KOH mg/g) | 40 | 37 | 42 | 25 | 27 | 25 | 27 | 48 | 46 |
| AV + OHV (KOH mg/g) | 42 | 39 | 46 | 47 | 46 | 47 | 46 | 70 | 69 |
| Tm (° C.) | 115 | 110 | 101 | 108 | 100 | 97 | 102 | 121 | 106 |

TABLE 1-continued

| | Linear Polyester | | | | | | | Cross-linked Polyester | |
|---|---|---|---|---|---|---|---|---|---|
| | Low AV | | | High AV | | | | | |
| | High← Tm →Low | | | High← Tm →Low | | | High Tg | High Tm | Low Tm |
| | Resin A | Resin B | Resin C | Resin D | Resin E | Resin F | Resin G | Resin H | Resin I |
| Tg (° C.) | 64 | 64 | 61 | 61 | 59 | 52 | 65 | 67 | 61 |
| Mw | $3.2 \times 10^4$ | $1.2 \times 10^4$ | $1.0 \times 10^4$ | $1.2 \times 10^4$ | $1.3 \times 10^4$ | $1.6 \times 10^4$ | $6.6 \times 10^3$ | $1.0 \times 10^4$ | $8.8 \times 10^5$ |

[1)]Polypropylene oxide adduct of Bisphenol A (2.2 mol-product)
[2)]Polyethylene oxide adduct of Bisphenol A (2.0 mol-product)
Note) The unit of the amount of the starting materials is "g".

Example 1

In a Henschel mixer were sufficiently mixed 90 parts by weight of Resin A and 10 parts by weight of Resin B as resin binders; 3 parts by weight of "P.Y. 17" for yellow toner, 6 parts by weight of "P.R. 122" for magenta toner or 3 parts by weight of "P.B. 15:3" for cyan toner, as a colorant; 2 parts by weight of "Carnauba Wax C1" (manufactured by Kato Yoko K.K., melting point: 73° C.) as a releasing agent; and 2 parts by weight of "BONTRON E-84" (manufactured by Orient Chemical Co., Ltd.) as a charge control agent. Thereafter, the mixture was melt-kneaded by a twin-screw extruder, cooled, thereafter pulverized, and classified, to give a powder having a weight-average particle size of 7.5 μm. To 100 parts by weight of the resulting powder was added 2 parts by weight of "HDK H2000" (manufactured by Wacker Chemicals) as an external additive, and the mixture was mixed by a Henschel mixer, whereby surface-treating the powder, to give each of yellow toner, magenta toner and cyan toner.

Examples 2 to 8 and 10 to 14 and Comparative Examples 1 to 4 and 7 to 9

The same procedures as in Example 1 were carried out except for using the resins listed in Table 2 as resin binders in place of 90 parts by weight of Resin A and 10 parts by weight of Resin B, to give each of yellow toner, magenta toner and cyan toner.

TABLE 2

| | Resin and Amount | AV (KOH mg/g) | OHV (KOH mg/g) | AV + OHV (KOH mg/g) | Tm (° C.) | Tg (° C.) | Mw |
|---|---|---|---|---|---|---|---|
| Comp. Ex. 1 | Resin B/100 | 2 | 37 | 39 | 110 | 64 | $1.2 \times 10^4$ |
| Ex. 1 | Resin B/90<br>Resin H/10 | 4 | 38 | 42 | 111 | 64 | $1.1 \times 10^5$ |
| Ex. 2 | Resin B/80<br>Resin H/20 | 6 | 39 | 45 | 112 | 64 | $2.2 \times 10^5$ |
| Ex. 3 | Resin B/60<br>Resin H/40 | 10 | 41 | 51 | 114 | 65 | $4.2 \times 10^5$ |
| Comp. Ex. 2 | Resin B/50<br>Resin H/50 | 12 | 43 | 55 | 116 | 66 | $5.2 \times 10^5$ |
| Ex. 4 | Resin A/100 | 2 | 40 | 42 | 115 | 64 | $3.2 \times 10^4$ |
| Ex. 5 | Resin A/40<br>Resin I/60 | 15 | 43 | 58 | 110 | 63 | $5.4 \times 10^5$ |
| Comp. Ex. 3 | Resin A/30<br>Resin I/70 | 17 | 44 | 61 | 109 | 62 | $6.2 \times 10^5$ |
| Ex. 6 | Resin E/100 | 19 | 27 | 46 | 100 | 59 | $1.3 \times 10^4$ |
| Ex. 7 | Resin E/40<br>Resin I/60 | 22 | 38 | 60 | 104 | 60 | $5.4 \times 10^5$ |
| Comp. Ex. 4 | Resin E/30<br>Resin I/70 | 22 | 40 | 62 | 104 | 60 | $6.2 \times 10^5$ |
| Ex. 8 | Resin C/100 | 4 | 42 | 46 | 101 | 61 | $1.0 \times 10^4$ |
| Ex. 9 | Resin C/100 | 4 | 42 | 46 | 101 | 61 | $1.0 \times 10^4$ |
| Comp. Ex. 5 | Resin C/100 | 4 | 42 | 46 | 101 | 61 | $1.0 \times 10^4$ |
| Comp. Ex. 6 | Resin C/100 | 4 | 42 | 46 | 101 | 61 | $1.0 \times 10^4$ |
| Ex. 10 | Resin C/40<br>Resin I/60 | 16 | 44 | 60 | 103 | 61 | $5.3 \times 10^5$ |
| Comp. Ex. 7 | Resin C/30<br>Resin I/70 | 17 | 45 | 62 | 103 | 61 | $6.2 \times 10^5$ |
| Ex. 11 | Resin A/50<br>Resin F/50 | 12 | 33 | 45 | 104 | 59 | $1.6 \times 10^4$ |
| Comp. Ex. 8 | Resin A/40<br>Resin F/60 | 14 | 31 | 45 | 102 | 57 | $1.6 \times 10^4$ |
| Ex. 12 | Resin G/50<br>Resin F/50 | 20 | 26 | 46 | 98 | 59 | $1.1 \times 10^4$ |
| Comp. Ex. 9 | Resin G/40<br>Resin F/60 | 21 | 26 | 47 | 97 | 57 | $1.2 \times 10^4$ |

TABLE 2-continued

| | Resin and Amount | AV (KOH mg/g) | OHV (KOH mg/g) | AV + OHV (KOH mg/g) | Tm (° C.) | Tg (° C.) | Mw |
|---|---|---|---|---|---|---|---|
| Ex. 13 | Resin B/80<br>Resin E/20 | 5 | 35 | 40 | 108 | 63 | $1.2 \times 10^4$ |
| Ex. 14 | Resin D/100 | 22 | 25 | 47 | 108 | 61 | $1.2 \times 10^4$ |
| Ex. 15 | Resin D/100 | 22 | 25 | 47 | 108 | 61 | $1.2 \times 10^4$ |
| Comp. Ex. 10 | Resin D/100 | 22 | 25 | 47 | 108 | 61 | $1.2 \times 10^4$ |
| Comp. Ex. 11 | Resin D/100 | 22 | 25 | 47 | 108 | 61 | $1.2 \times 10^4$ |

Note) The amounts are shown by "parts by weight".

Example 9 and Comparative Example 5

The same procedures as in Example 8 were carried out except for using as a releasing agent 2 parts by weight of "SP-105" (manufactured by Sazole, polyethylene wax, melting point: 84° C.) in Example 9 and 2 parts by weight of "NP-055" (manufactured by Mitsui Petrochemical Industries, Ltd., polypropylene wax, melting point: 126° C.) in Comparative Example 5, in place of "Carnauba Wax C1", to give each of yellow toner, magenta toner and cyan toner.

Comparative Example 6

The same procedures as in Example 8 were carried out except for changing the amount of "HDK H2000" to 0.8 parts by weight, to give each of yellow toner, magenta toner and cyan toner.

Example 15 and Comparative Example 10

The same procedures as in Example 14 were carried out except for using as a releasing agent 2 parts by weight of "SP-105" (manufactured by Sazole, polyethylene wax, melting point: 84° C.) in Example 15 and 2 parts by weight of "NP-055" (manufactured by Mitsui Chemical Co., Ltd., polypropylene wax, melting point: 126° C.) in Comparative Example 10, in place of "Carnauba Wax C1", to give each of yellow toner, magenta toner and cyan toner.

Comparative Example 11

The same procedures as in Example 14 were carried out except for changing the amount of "HDK H2000" to 0.8 parts by weight, to give each of yellow toner, magenta toner and cyan toner.

Example 16

The same procedures as in Example 2 were carried out to give yellow toner, the same procedures as in Example 4 were carried out to give magenta toner, and the same procedures as in Example 6 were carried out to give cyan toner, respectively.

The acid value (AV), the hydroxyl value (OHV), the sum of the acid value and the hydroxyl value (AV+OHV), the softening point (Tm) and the glass transition point (Tg) of the yellow toners obtained in Examples 1 to 15 and Comparative Examples 1 to 11, and the weight-average molecular weight (Mw) of each of the resin binders used are shown in Table 2. Incidentally, all of the magenta toners and the cyan toners obtained in each of Examples and Comparative Examples also had the same properties as those of the yellow toners, although the respective colorants contained were different.

Test Example 1 [Evaluation of Fixable Region]

In a ball-mill rotated at 250 r/min were mixed 5 parts by weight of each of the toners obtained in Examples and Comparative Examples and 95 parts by weight of a ferrite carrier coated with a silicone resin and having a particle size of 50 $\mu$m, to prepare each of yellow, magenta, and cyan developers.

Each of the resulting developers was evaluated by a fixable temperature region as determined by using a modified apparatus of "Preter 550" (manufactured by Ricoh), in which an upper roller of the fixing device was changed to a soft roller attached with a silicone rubber tube, and a silicone oil-coating device was detached therefrom, in accordance with the following evaluation criteria. Incidentally, the sheets of paper used for printing images are Xerox Paper 4200. The results are shown in Table 3.

[Evaluation Criteria]

◎: Fixable temperature region exceeding 50° C., particularly favorable in practical use.

○: Fixable temperature region being from 30° to 50° C., favorable in practical use.

x: Fixable temperature region being less than 30° C., making its practical use impossible.

Test Example 2 [Evaluation of Durability]

Each of the developers prepared in Test Example 1 was loaded on "Preter 550" (manufactured by Ricoh) modified in the same manner as in Test Example 1. Printing was carried out continuously for 300,000 sheets with a printing ratio of 4% for each color. The fixed images obtained were visually examined and evaluated in accordance with the following evaluation criteria. The results are shown in Table 3.

[Evaluation Criteria]

◎: Particularly favorable in practical use.

○: Favorable in practical use.

x: Making its practical use impossible.

Test Example 3 [Evaluation of Color Reproducibility]

The same amounts of yellow toner, magenta toner and cyan toner obtained in Examples and Comparative Examples were loaded to a nonmagnetic one-component developer device "TEKTRONIX PHASER 560" (manufactured by SONY TEKTRONIX) equipped with a heat roller. The developing bias was adjusted so as to have an amount of each of monochromatic yellow, magenta, and cyan colors deposited of 0.6 mg/cm$^2$, to obtain the yellow solid images, the magenta solid images, the cyan solid images, the process-red solid images, the process-green solid images, and the process-blue solid images. Each of a* and b* of the fixed images was measured with "X-Rite 938" (manufactured by X-Rite), and the degrees of coloration for a* and b* were plotted. The resulting hexagonal area was measured, whereby evaluating the color reproducibility in accordance with the following evaluation criteria. The results are shown in Table 3.

[Evaluation Criteria]

◎: The area exceeding 6,000, particularly favorable in practical use.

○: The area being from 3,500 to 6,000, favorable in practical use.

x: The area being less than 3,500, making its practical use impossible.

TABLE 3

| | Fixable Region | Durability | Color Reproducibility | Remarks |
|---|---|---|---|---|
| Comp. Ex. 1 | ◎ | X | ◎ | A linear polyester having a low AV; and intermediate Tm, Tg |
| Ex. 1 | ◎ | ○ | ◎ | A combination of a linear polyester having a low AV; and |
| Ex. 2 | ◎ | ◎ | ○ | intermediate Tm, Tg with a cross-linked polyester having a high |
| Ex. 3 | ○ | ◎ | ○ | OHV + AV; and high Tm, Tg |
| Comp. Ex. 2 | X | ◎ | X | |
| Ex. 4 | ○ | ◎ | ◎ | A linear polyester having a low AV; and high Tm, Tg |
| Ex. 5 | ◎ | ○ | ○ | A combination of a linear polyester having a low AV; and high |
| Comp. Ex. 3 | ◎ | ○ | X | Tm, Tg with a cross-linked polyester having a high OHV + AV; and low Tm, Tg |
| Ex. 6 | ○ | ○ | ◎ | A linear polyester having a high AV; and intermediate Tm, Tg |
| Ex. 7 | ◎ | ○ | ○ | A combination of a linear polyester having a high AV; and |
| Comp. Ex. 4 | ◎ | ○ | X | intermediate Tm, Tg with a cross-linked polyester having a high OHV + AV; and low Tm, Tg |
| Ex. 8 | ◎ | ◎ | ◎ | A linear polyester having a low AV; and low Tm, Tg |
| Ex. 9 | ○ | ◎ | ○ | |
| Comp. Ex. 5 | X | ◎ | X | |
| Comp. Ex. 6 | ◎ | X | ◎ | |
| Ex. 10 | ○ | ○ | ○ | A combination of a linear polyester having a low AV; and low |
| Comp. Ex. 7 | ◎ | ○ | X | Tm, Tg with a cross-linked polyester having a high OHV + AV; and low Tm, Tg |
| Ex. 11 | ◎ | ○ | ◎ | A combination of a linear polyester having a low AV; and high |
| Comp. Ex. 8 | ◎ | X | ◎ | Tm, Tg with a linear polyester having a high AV; and low Tm, Tg |
| Ex. 12 | ◎ | ○ | ◎ | A combination of a linear polyester having a high AV; a low Tm; |
| Comp. Ex. 9 | ◎ | X | ◎ | and a high Tg with a linear polyester having a high AV; and low Tm, Tg |
| Ex. 13 | ◎ | ○ | ◎ | A combination of a linear polyester having a low AV; and intermediate Tm, Tg with a linear polyester having a high AV; and intermediate Tm, Tg |
| Ex. 14 | ◎ | ◎ | ◎ | A linear polyester having a high AV; and high Tm, Tg |
| Ex. 15 | ○ | ◎ | ○ | |
| Comp. Ex. 10 | X | ◎ | X | |
| Comp. Ex. 11 | ◎ | X | ◎ | |
| Ex. 16 | ○ | ○ | ○ | A combination of toners using different polyesters |

It is clear from the above results that the toner of Comparative Example 1 is poor in the durability because the sum of the acid value and the hydroxyl value is too small; the toner of Comparative Example 2 has a narrow fixable region because the glass transition point and softening point are too high and is poor in the color reproducibility because a large amount of the cross-linked polyester is used; the toners of Comparative Examples 3, 4 and 7 are poor in the color reproducibility because the sum of the acid value and the hydroxyl value is too large and a large amount of the cross-linked polyester is used; the toners of Comparative Examples 8 and 9 are poor in the durability because the glass transition point is too low; the toners of Comparative Examples 5 and 10 are poor in the fixable region and the color reproducibility because the melting point of the releasing agent is too high; and the toners of Comparative Examples 6 and 11 are poor in the durability because they contain a small amount of the external additive; and that the toners of Examples, in contrast, are excellent in all these properties.

According to the present invention, there can be provided a toner for full color development having a wide fixable region, and being excellent in the durability and the color reproducibility.

What is claimed is:

1. A toner for full color development comprising:

(a) a resin binder comprising a polyester;

(b) a releasing agent having a melting point of 60° to 115° C.;

(c) a colorant; and (d) an external additive, wherein the toner has a sum of an acid value and a hydroxyl value of from 40 to 60 KOH mg/g, a softening point of from 97° to 115° C., and a glass transition point of from 58° to 65° C., and wherein the amount of the external additive is from 1 to 5 parts by weight, based on 100 parts by weight of a toner without a treatment with the external additive.

2. The toner according to claim 1, wherein the resin binder has a weight-average molecular weight of from $1.0\times10^3$ to $1.0\times10^6$.

3. The toner according to claim 1, wherein the polyester comprises one or more polyesters having an acid value of 50 KOH mg/g or less, a hydroxyl value of from 10 to 60 KOH mg/g, a sum of an acid value and a hydroxyl value of from 20 to 100 KOH mg/g, a softening point of from 95° to 125° C., and a glass transition point of from 50° to 70° C.

4. The toner according to claim 1, wherein the toner has an acid value of from 1 to 50 KOH mg/g and a hydroxyl value of from 10 to 60 KOH mg/g.

5. The toner according to claim 1, wherein the resin binder comprises the polyester in an amount of from 50 to 100% by weight.

6. The toner according to claim 1, wherein the polyester is obtainable by polycondensing an alcohol component comprising, in an amount of 5% by mol or more, a compound represented by the formula (I):

(I)

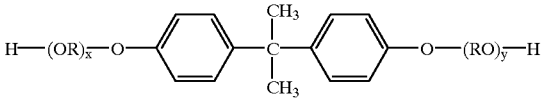

wherein R is an alkylene group having 2 to 4 carbon atoms, and each of x and y is a positive number, wherein a sum of x and y is from 1 to 16, with a carboxylic acid component comprising a dicarboxylic acid compound.

7. The toner according to claim 1, wherein the polyester comprises a cross-linked polyester and a linear polyester, wherein a weight ratio of the cross-linked polyester to the linear polyester is from 70/30 to 0/100.

8. The toner according to claim 1, wherein the releasing agent is carnauba wax.

9. The toner according to claim 1, wherein the external additive is a hydrophobic silica.

10. The toner according to claim 1, wherein the toner is a pulverized toner.

* * * * *